United States Patent [19]

Tanahashi

[11] Patent Number: 4,589,205

[45] Date of Patent: May 20, 1986

[54] INNER CUTTER FOR ELECTRIC SHAVERS

[75] Inventor: Masao Tanahashi, Hikone, Japan

[73] Assignee: Matsushita Electric Works, Ltd., Osaka, Japan

[21] Appl. No.: 584,266

[22] Filed: Feb. 27, 1984

[30] Foreign Application Priority Data

Mar. 28, 1983 [JP] Japan ..... 58-52246

[51] Int. Cl.[4] ..... B26B 19/12

[52] U.S. Cl. ..... 30/43.8; 30/43.9; 30/43.91; 30/346.55; 30/346.51

[58] Field of Search ..... 30/43.8, 43.9, 43.91, 30/43.92, 346.51, 43.4, 43.5, 346.55

[56] References Cited

U.S. PATENT DOCUMENTS

| | | | |
|---|---|---|---|
| 2,337,623 | 12/1943 | Romao | 30/43.92 |
| 2,355,898 | 8/1944 | Saxe | 30/43.92 |
| 3,060,572 | 10/1962 | Duncan | 30/43.92 |
| 3,088,205 | 5/1963 | Ellis | 30/43.9 X |
| 3,927,581 | 12/1975 | Kolodziej | 30/346.51 X |
| 3,967,373 | 7/1976 | Sakai et al. | 30/43.92 |

*Primary Examiner*—E. R. Kazenske
*Assistant Examiner*—Willmon Fridie, Jr.
*Attorney, Agent, or Firm*—Pollock, Vande Sande & Priddy

[57] ABSTRACT

An inner cutter for electric shavers is disclosed. The inner cutter comprises a plurality of inner blades mounted on a base member to be driven to move in sliding engagement with an outer shearing plate having a number of perforations therein. Each inner blade has along its length the cutting edge of different configurations including at least a toothed edge so as to define a first cutting edge of a greater overall width determined by the amount of projection of the tooth in the direction of movement of the inner blade and a second cutting edge in the form of a straight edge or toothed edge of an overall width less than that of the first cutting edge. The first cutting edge is responsible for efficiently capturing and cutting long hairs into shorter ones, while the second cutting edge is for giving a close shave on the skin of a user. Accordingly, the long hairs can receive two different cutting operations at each inner blade so as to be in a close cut after being successfully captured. In such a manner, the above unique edge configuration enables the efficient cutting operation for both long and short hairs.

8 Claims, 16 Drawing Figures

INNER CUTTER FOR ELECTRIC SHAVERS

BACKGROUND OF THE DISCLOSURE

1. Fields of the Invention

This invention is directed to an inner cutter for electric shavers adapted for use in connection with an outer shearing plate for a cutting operation, more particularly an inner cutter for improving sharp cutting performance while retaining the effect of capturing long hairs to be cut.

2. Description of the Prior Art

It has been known that an inner blade in the form of a cutting edge having zig-zag configuration can increase the effect of capturing and shearing hairs as disclosed in U.S. Pat. No. 3,092,904. However, a further investigation into the mechanism of shearing hairs reveals that the above prior inner blade of a zig-zag configuration suffers the following shortcomings:

(i) such prior inner blade is found to be effective for cutting long hairs, but not to be satisfactory for cutting upright short hairs or effecting a close shave. This can be explained with reference to FIGS. 13 and 14 illustrating schematically the cutting mechanism for a short hair 13. As shown in FIG. 14, such short hair 13 entered through a given perforation 15 in an outer shearing plate 11 will have the increased chance of being cut by the inner blade 10 alone rather than by the cooperation with the cutting edge of the perforation. At this occurrence, the short hair 13, when it encounters the ridge of the inner blade 10 as shown in FIG. 13, is subject to slippage $S_0$ along the side of the ridge to the adjacent groove as the inner blade 10 moves in one direction indicated by the arrow, which causes the short hair to be pushed forwardly by the inner blade 10 and cut at a point away from the skin 14, therefore remaining on the skin, requiring a further chance of being encountered by the inner blade.

(ii) its serration uniformly formed along the entire length thereof will certainly increase the contacting area with the outer shearing plate such that the inner blade is subject to an unduly increased load or resistance to the motion thereof.

(iii) the above uniform serration will increase the overall rigidity of the inner blade so as to fail to provide a comfortable cutting sound.

SUMMARY OF THE INVENTION

The above disadvantages and shortcomings have been eliminated by the present invention which discloses a novel inner blade profile characterized in that its cutting edge is shaped to have along its length first and second positions of different configurations including in said first portion at least one toothed edge. It is a primary object of the present invention to provide an inner cutter for electric shavers capable of enhancing the performance of cutting short hairs or effectuating a close shave, while retaining good performance of capturing long hairs to be cut.

In the present invention, there is disclosed a variety of inner blades adapted for use in shavers of different types including reciprocating and rotary ones.

DETAILED DESCRIPTION OF THE DISCLOSURE

Figure 1:
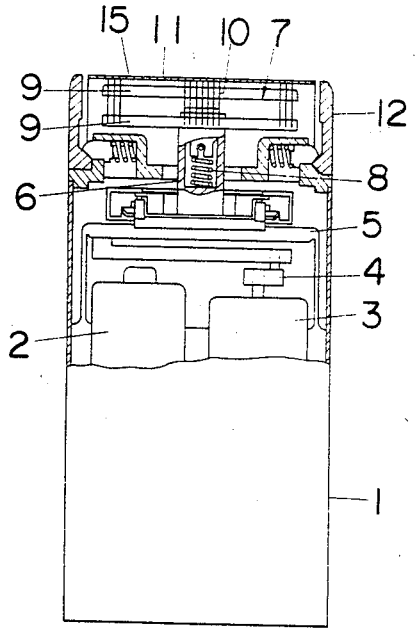
FIG. 1 is a sectional view partly in elevation of a reciprocating electric shaver to which the inner cutter of the present invention is applied.

Referring now to FIG. 1, there is shown an electric shaver of a reciprocating type to which the inner cutter of the present invention is applied. The shaver comprises a housing 1 and a cutter head mounted on the housing 1. The cutter head is composed of an outer shearing plate 11 being arcuate in transverse section, a frame 12 detachably mounted at the upper end of the housing 1 and holding the outer shearing plate 11, and an inner cutter assembly 7 in which a number of arcuate inner blades 10 are mounted in parallel on a base members 9 to be arranged longitudinally of the outer shearing plate 11. Disposed within the housing 1 are a battery 2 and a motor 3 operatively connected to the inner cutter assembly 7 for the reciprocation thereof by means of a driving connection. Said driving connection includes an eccentric cam 4 secured to the rotary output shaft of the motor 3, a driving member 5 to be driven by the cam 4 to reciprocate, a coupling member 6 interconnecting the driving member 5 and the inner cutter assembly 7. A biasing spring 8 is employed for pressing the inner blades 10 into contact with the under surface of the outer shearing plate 11. The outer shearing plate 11 is provided therein with a number of perforations 15 through which long and short hairs enter to be cut by said inner blades 10 reciprocating in sliding engagement with the outer shearing plate 11.

Figure 2:
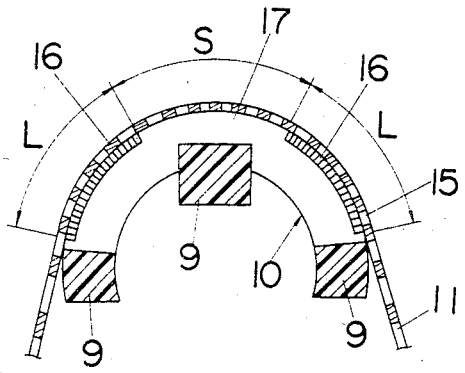
FIG. 2 is a sectional view of the cutter head of the reciprocating shaver illustrating the relationship between an inner blade and an outer shearing plate in accordance with one preferred embodiment of the present invention.
Figure 3:
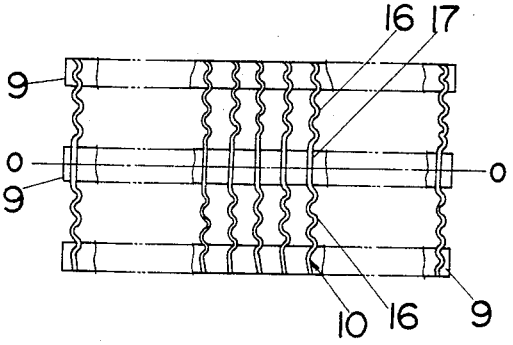
FIG. 3 is a plane view of the above inner cutter in which the serration of each inner blade is shown greatly exaggerated for clarity.
Figure 4:
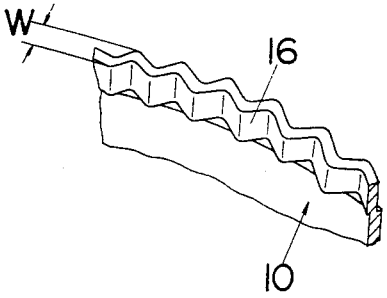
FIG. 4 is a partial perspective view of the above inner blade.

In normal operating condition, the shaver of the above construction is generally used in such a manner that, as shown in FIG. 2, the opposite peripheral portions of each inner blade 10 serve as long-hair-combing regions L for combing or cutting long hairs into shorter ones, while the middle portion thereof serves as short-hair-cutting region S for cutting short hairs or providing a close shave on the skin of the user. Each of said inner blades 10 is formed to present a continuous top face which is in sliding contact with the outer shearing plate 11 along the entire length thereof and which has cutting edges on both sides thereof. As shown in FIGS. 2 through 4, in a preferred embodiment of the present embodiment, each inner blade 10 is shaped such as by coining to have at the portion corresponding to the above long-hair-combing region L the cutting edge in the form of a toothed edge 16 defined by a series of longitudinally aligned ridges alternated by grooves, and to have the cutting edge in the form of a straight edge 17 at the remaining portion corresponding to the above short-hair-cutting region S. Said toothed edge 16 thus formed is to have an overall width W determined by the distance between the apexes of the ridges on the opposite sides, such overall width W being in the direction of movement of the inner blade 10 and being greater than the width of said straight edge 17 or the thickness thereat. The toothed edges 16 of each inner blade 10 in this instance are arranged symmetrically with respect to the longitudinal center line O—O of the inner blade assembly 7 as shown in FIG. 3.

Figure 5:
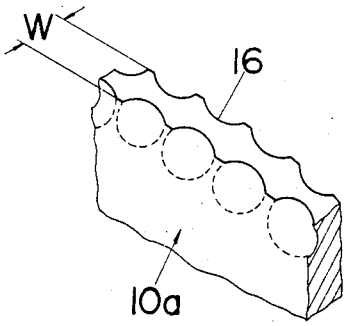
FIG. 5 is a partial perspective view of a modification of the inner blade of FIG. 4.

FIG. 5 shows a modification of the above inner blade in which the toothed edge 16 of an inner blade 10*a* is formed by undercutting spherically the portion just below the top face of the inner blade 10*a* in such a way as to define an overall width W by the maximum thickness of the blank material. The overall width W similarly determined between the apexes of the ridges on both sides may be dimensioned to be less than the thickness of the blank material.

Figure 6A:
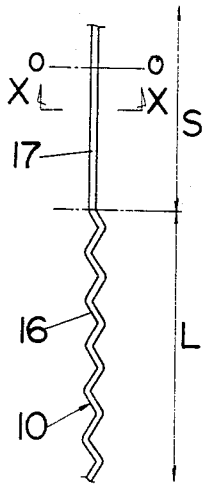
FIGS. 6A to 6C are respectively partial plane views in schematic representation of inner blades which can be utilized in the present invention.
Figure 6B:
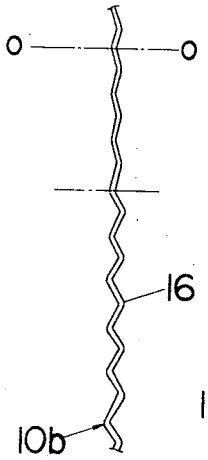
Figure 6C:
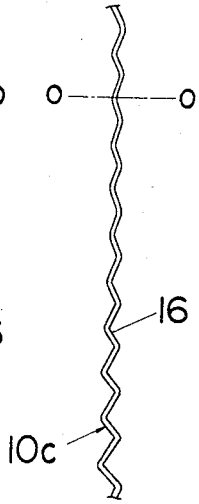
Figure 7:
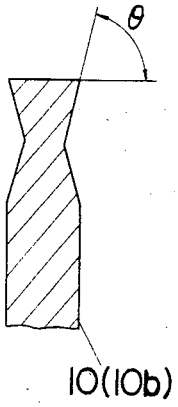
FIG. 7 is a cross section taken along line X—X of FIG. 6B.

FIG. 6A shows the cutting edge configuration of the inner blade employed in the above instance, in which the inner blade 10 is shaped to have at the portion corresponding to said long-hair-cutting region L the cutting edges in the form of a toothed edge 16 and to have at the portion corresponding to said short-hair-cutting region S the cutting edge in the form of a straight edge 17, said toothed edge 16 having the serration of the same amplitude or the same overall width along the entire length thereof. FIGS. 6B and 6C show the modifications of the inner blade in which toothed edges are formed respectively along the entire length of inner blades 10*b* and 10*c* but the overall width of each inner blade is continuously narrower toward the middle of its length than at either longitudinal end, presenting the toothed edge of a larger overall width at the portions corresponding to said long-hair-cutting region L and at the same time presenting the toothed edge of a relatively less overall width at the portion corresponding to said short-hair-cutting region S. In FIG. 6C, the ridges of the toothed edge are rather rounded as compared to those of the toothed edge of FIG. 6B. The inner blades 10 and 10*b* of FIGS. 6A and 6B are formed respectively at the straight edge portion and the portion of a less overall width to be undercut and inclined at an obtuse angle to the direction of movement thereof so as to have an acute included angle $\theta$, as shown in FIG. 7.

Figure 8:
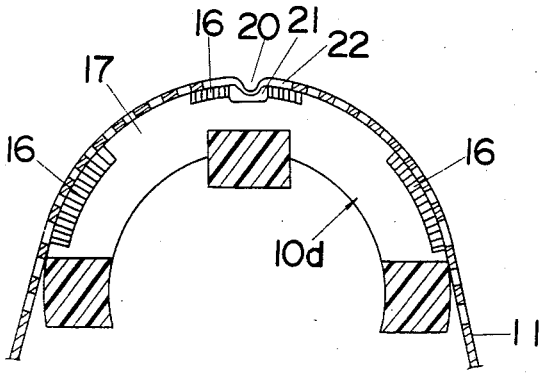
FIG. 8 is a sectional view of the cutter head of an alternative reciprocating shaver illustrating the relationship between an inner blade and an outer shearing plate in another preferred embodiment of the present invention.

Referring to FIG. 8, there is disclosed an inner blade 10*d* adapted to be cooperative with an outer shearing plate 11 having a hair entrance channel 20 at the crest of the plate 11. The hair entrance channel 20 is of a generally U-shaped configuration in transverse section and extends longitudinally of the outer shearing plate 11 for guiding or combing long hairs into the engagement with the inner blades 10*d*, particularly the long hairs lying flat on the skin of a user or fuzzy hairs. The channel 20 is provided with perforations 21 elongated outwardly and laterally from the shoulders thereof. Each of the inner blades 10*d* has at its middle a cutout 22 for receiving said channel 20 and is formed with said toothed edges 16 of a greater overall width at the portion adjacent to the above channel 20 to effectuate the above combing operation, in addition to at the longitudinal end portions.

Figure 9:
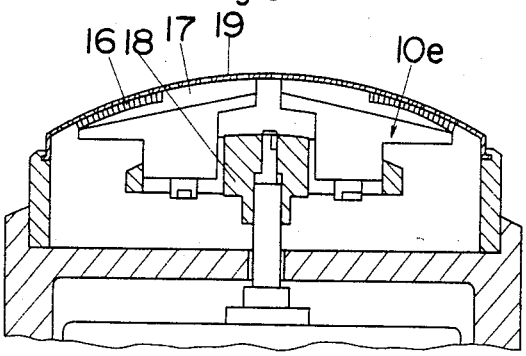
FIG. 9 is a sectional view of the cutter head of a rotary shaver illustrating the relationship between an inner blade and an outer shearing plate in a further preferred embodiment of the present invention.
Figure 10:
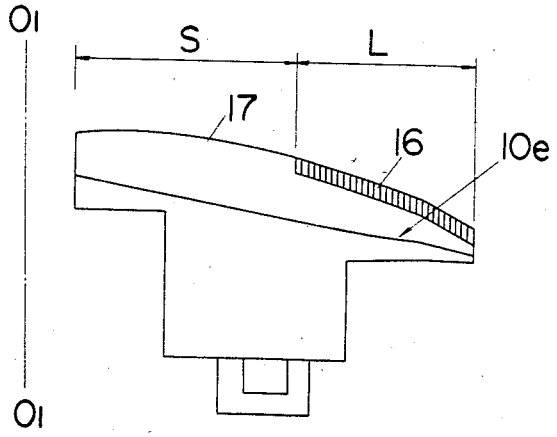
FIG. 10 is an elevational view of the inner blade employed in the rotary shaver of FIG. 9.
Figure 11:
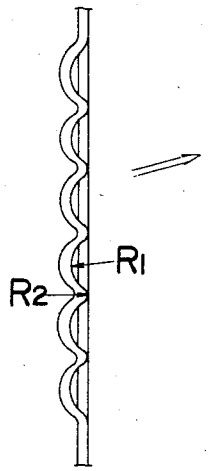
FIG. 11 is a plane view of a part of the inner blade of FIG. 10.

FIG. 9 shows the cutter head of a rotary-type shaver to which the present invention can be also applied. A plurality of inner blades 10*e* are mounted on a base member 18 in a circumferentially spaced relationship so as to be rotated along the under surface of an outer shearing plate 19. As shown in FIGS. 10 and 11, each inner blade 10*d* is formed to have a cutting edge at its leading edge which approaches the under surface of the outer shearing plate 19 as the base member 18 rotates, and each inner blade 10*d* is shaped to have at its peripheral portion a cutting edge in the form of a toothed edge 16 defining the long-hair-cutting region L while to have at the portion near the center of rotation $O_1$—$O_1$ a straight cutting edge 17 defining the short-hair-cutting region S. In this instance, the ridges and the grooves of the toothed edge 16 are rounded in such a relationship that the radius of the curvature $R_2$ of the ridge is less than that $R_1$ of the groove. As seen in the above, since the inner blade 10*e* of the type employed for the rotary shaver only requires a cutting edge on one side thereof, the edge configuration can be designed into an optimum shape for its maximum cutting efficiency without giving a thought to the configuration on the opposite side, which should otherwise be taken into account in the case of the inner blade for a reciprocating shaver. Alternatively, the inner blade 10*e* may be formed to have instead of said straight edge a toothed edge of an overall width less than that of at the peripheral portion. The construction of this rotary shaver other than the configuration of the inner blade is of known type and therefore the explanation thereof can be omitted.

Figure 12:
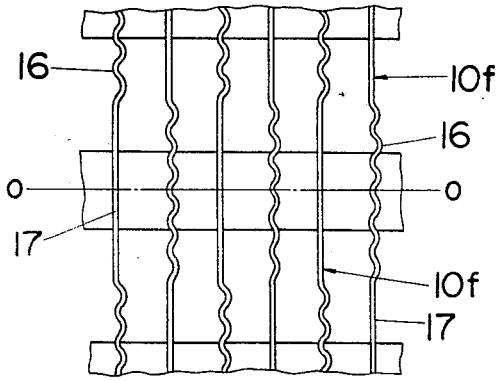
FIG. 12 is a partial plane view of a reciprocating cutter head in a still further embodiment of the present invention in which the serration of the inner blade is shown greatly exaggerated for clarity.

Referring to FIG. 12, there is shown another advantageous arrangement of the inner blades for a reciprocating shaver in which a plurality of inner blades 10*f* each having toothed and straight edges 16 and 17 at different portions are arranged parallel with each other in the direction of movement of the inner blades 10*f*, and arranged in a staggered relationship with respect to the toothed edges 16 in such a way that the area extending transversely of the cooperating outer shearing plate (not shown) can be in sliding engagement with both the toothed and straight edges 16 and 17 as the inner blades 10*f* move in a reciprocating manner. In this sense, the inner blade assembly may have at least one pair of adjacent inner blades arranged in the above staggered relationship. This arrangement can also be successfully applied to the inner blade assembly for said rotary shaver.

Figure 13:
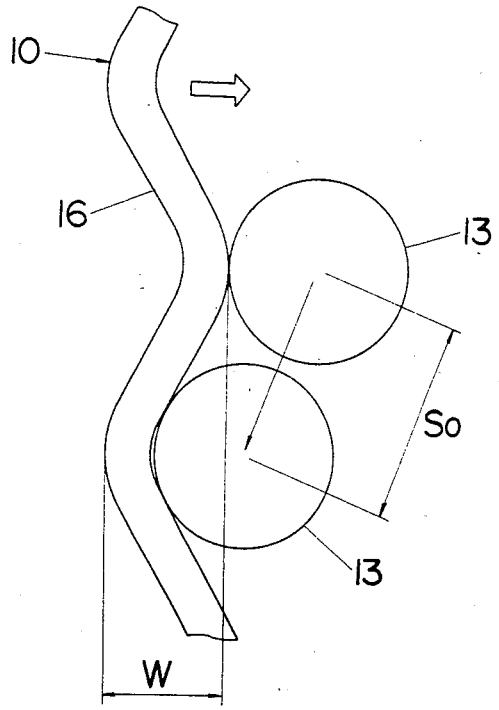
FIG. 13 is an explanatory view schematically illustrating the mechanism of capturing and cutting a hair by a toothed cutting edge of the inner blade.
Figure 14:
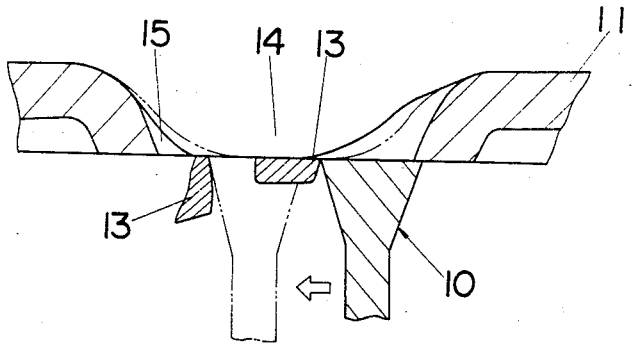
FIG. 14 is an explanatory view schematically illustrating the mechanism of cutting a short hair by the inner blade.

In operation, the toothed edge with a greater overall width serves to effectively entrap the hairs to be cut by collecting the hair 13 into each groove of the toothed edge, as shown in FIG. 13, while leaving the hair to still remain on the skin in this cutting operation. This results from the slippage $S_0$ in the above hair collecting action as well as the fact that the greater overall width of the toothed edge serves to prevent the skin or the base of the hair from getting into a close engagement with the toothed edge. On the other hand, at the cutting edge in the form of a straight edge or toothed edge of a less overall width, there is no substantial slippage during the cutting operation and the skin is allowed to be into a close engagement with the cutting edge so as to give a close shave on the skin. This is more easily understood from FIG. 14 that the skin 14 corresponding to the above cutting edge projects deeply into a given perforation 15 of the outer shearing plate 11 where the inner blade has increased chances to cut the hair 13 by itself rather than by cooperation with the outer shearing plate 11, providing the immediate cutting of the hair 13 at the closest portion to the skin, i.e., the close shave on the skin. Accordingly, each inner blade has different functional segments along its length, one is the cutting edge in the form of a toothed edge with a greater overall width in the direction of movement of the inner blade for efficiently capturing the long hairs or the hairs lying flat on the skin to comb or cut into shorter hairs, and the other is the cutting edge in the form of a straight edge or in the form of a toothed edge with a less overall width for cutting the short hairs from near the skin base. In this sense, the former segment serves as said long-hair-cutting region L, and the latter as said short-hair-cutting region S.

With this arrangement, the user can enjoy excellent cutting performance by selectively utilizing the long-hair-cutting region L and the short-hair-cutting region S. Also associated with the above arrangement are advantageous features that the contacting area with the outer shearing plate is reduced as compared to the inner blade having along its entire length a toothed edge of the same overall width so as to be subject to a less load, and that the rigidity of the inner blade is partially reduced to produce a comfortable cutting sound. These features become most effective or conspicuous when the cutting edge in the form of a straight edge or of a toothed edge of a less overall width is finished by said undercutting to have a sharp included angle.

In the instance of the inner blades for a reciprocating shaver as shown in FIG. 8, the toothed edges 16 formed ajacent to the hair combing channel 20 can be cooperative therewith to further enhance the performance of capturing long hairs, particularly hairs lying flat on the skin or fuzzy hairs. In addition to the above, said toothed edges 16 can serve to compensate for the drop in rigidity due to the formation of cutout 21 in the cutting edge for receiving said channel 20, maintaining sharp cutting performance as well as assuring a longer life.

As seen in FIG. 12, the arrangement of the inner blades in a staggered relationship with respect to the toothed edge of a greater overall width enables the hair or hairs received in any given perforation to encounter both toothed and straight edges 16 and 17 as the inner cutter assembly reciprocates, such that the hair or hairs entrapped in one perforation of the outer shearing plate can receive the above two different cutting operations to raise the cutting efficiency.

Further in the instances of FIGS. 6B and 6C, the toothed edge is formed with its overall width being continuously varied along the length of the cutting edge, such that a uniform stress can be developed in the tooth forming operation, thus preventing the local stress concentration which results in breakage and keeping the cutting edge sharp in an extended life.

The above description and particularly the drawings are set forth for purposes of illustration only. It will be understood that many variations and modifications of the embodiments herein described will be obvious to those skilled in the art, and may be carried out without departing from the spirit and scope of the invention.

What is claimed is:

1. In an electric shaver having an outer shearing plate perforated to receive hairs to be cut when said shearing plate is moved over a hair growing surface, an inner cutting comprising:

a plurality of cutting blades arranged in parallel with each other in the direction of movement of the shaver, each of said cutting blades having a cutting edge which includes a first edge portion comprising a toothed edge for efficiently cutting longer hairs, and a second portion comprising a straight edge or a toothed edge having a width between apexes of ridges less than a corresponding width of said first edge portion for efficiently cutting shorter hairs, and each cutting blade being staggered so that adjacent cutting blades have said first edge portion adjacent another blade's second edge portion.

2. An inner cutter for electric shavers as set forth in claim 1, wherein said inner blades are driven to reciprocate in sliding contact with the outer shearing plate and have on both sides the cutting edge, said cutting edge having at the middle of its length the second edge portion and said first edge portion being formed at the longitudinal end portions of said inner blade.

3. In an electric shaver having an outer shearing plate perforated to receive hairs to be out when said shearing plate is moved over a hair growing surface, and at least one inner cutting blade for rotation around the undersurface of said shearing plate, an inner cutting blade comprising a cutting edge having a first portion with a toothed edge defined by a series of ridges alternated by grooves, said ridges having a steeper slope than the slope of adjacent grooves, and said cutting edge having a second portion comprising a straight edge or a toothed edge having a width between apexes of ridges less than a corresponding width of said first portion toothed edge, whereby longer hairs are efficiently captured and cut between said first cutting edge portion and said shearing plate, and shorter hairs are effectively cut be said second edge portion.

4. An inner cutter for electric shaver as set forth in claim 3, wherein said outer shearing plate has a hair combing channel elongated along the direction of movement of the inner blade, said channel having the bottom projecting on the under surface of the outer shearing plate and having sides with a series of perforations arranged in longitudinal arrays, said perforations in the sides of the channel being cooperative with adjacent first edge portions of the inner blade for a shearing operation.

5. An inner cutter for electric shavers as set forth in claim 3, wherein the amount of projection of the toothed edge in the direction of movement of the inner blade is continuously varied along the length of the inner blade.

6. An inner cutter for electric shavers according to claim 3 wherein said second cutting edge portion is undercut and inclined at an obtuse angle to the direction of movement of the inner blade so as to have an acute included angle.

7. The cutting blade of claim 3 wherein said second cutting edge portion is located adjacent said shearing plate center, and said first edge portions are located adjacent the periphery of said shearing plate.

8. In an electric shaver having an outer sharing plate perforated to receive hairs to be cut when said shaver is moved over a hair growing surface, an inner cutter for reciprocal movement with respect to the shear plate comprising:

a plurality of cutting blades each disposed in parallel, said cutting blades having peripheral first edge portions separated by a second edge portion, like edge portions of said blade being adjacent and parallel to like edge portions of an adjacent cutting blade, said first edge portions comprising a toothed edge for cutting longer hairs entering the periphery of said shear plate, and said second edge portions comprising a substantially straight edge for cutting hair previously cut by said first edge portions, whereby during use of said shaver, said hair is initially cut by said longer hair cutting first edge portions and subsequently cut by said shorter hair second edge portions.

* * * * *